United States Patent [19]

Parham et al.

[11] 4,239,236

[45] Dec. 16, 1980

[54] TARGET LIFE EXTENDER

[76] Inventors: Roger R. Parham, 613 South Sneve Ave.; Glenn D. Adler, 212 South LaSalle, both of Sioux Falls, S. Dak. 57103

[21] Appl. No.: 38,343

[22] Filed: May 11, 1979

[51] Int. Cl.[3] ..... F41J 3/00

[52] U.S. Cl. ..... 273/403; 273/404

[58] Field of Search ..... 273/403, 404, 410

[56] References Cited

U.S. PATENT DOCUMENTS

| | | | |
|---|---|---|---|
| 3,164,384 | 1/1965 | Stewart | 273/403 |
| 4,066,261 | 1/1978 | Stewart | 273/403 |

*Primary Examiner*—Anton O. Oechsle

*Attorney, Agent, or Firm*—Orrin M. Haugen; Thomas J. Nikolai

[57] ABSTRACT

A device for extending the useful life of an archery target in the form of a backup member which may be secured to the reverse side of the target proximate the central zone occupied by a replaceable bullseye plug. The backup member itself comprises a pillow-like pad which is contained within a cloth sleeve, the sleeve being closed at one end and open at its other end. The open end of the sleeve is sufficiently wide to fit around the circumference of the replaceable bullseye plug such that when the plug is inserted into the face of the target, the pillow-like pad is resiliently held in place behind the bullseye zone, preventing arrow pass-through even when the same spot on the bullseye zone has received repeated strikes.

5 Claims, 3 Drawing Figures

TARGET LIFE EXTENDER

BACKGROUND OF THE INVENTION

I. Field of the Invention

This invention relates generally to an improved archery target and more specifically to an accessory to be used with an archery target of the type having a replaceable bullseye so as to extend the useful life of the target/bullseye combination.

II. Discussion of the Prior Art

Several years ago, the most common archery target then in use comprised a relatively thick mat of straw which was bound by twine and formed into a relatively thick massive cylinder and on the face of this cylinder was positioned a paper or cloth having the conventional concentric circle patterns defining the target zones. Because of the mass of such targets and the fact that they absorb water when exposed to rain and the like, such targets were difficult to transport. Further, through repeated use, the straw and twine holding the target together would become severed by the repeated arrow strikes. When this condition arose, if frequently happened that the arrows would pass completely through the target backing and would be either lost or damaged.

Many of the disadvantages of the early straw-backed archery targets were obviated when it was found that various foamed plastic materials could be employed as a target backing. For example, as is set out in the Roloff et al. U.S. Pat. No. 3,476,390, by forming a laminated structure from layers of elastomeric foam and other plastic and cardboard layers. The prior art also teaches the use of rigid foam material as a target backing. For example, the Roloff et al. U.S. Pat. No. 3,762,709 suggests the use of polystyrene foam or foams manufactured from polyvinyl chloride. Target backings made from these materials not only solve the portability problem but also targets made from these synthetic plastic materials will not rot and attract insects as did the earlier straw target backings.

In spite of the significant improvement afforded by synthetic plastic foam target backing materials, a significant problem still remains in that after repeated strikes by arrows in the same location, the foam material tends to break away leaving a void. Since the highest incidents of arrow strikes is in the bullseye zone, it is this zone that is the first to deteriorate under conditions of continued use. It has been found that the overall life of the target can be increased if the bullseye zone is designed to be replaceable. That is, the central portion of the laminated foam plastic is cut out so that it can accommodate a plug, the plug being a replaceable item. In this regard, reference is made to the Dishon U.S. Pat. No. 3,048,401.

While the replaceable bullseye plug concept makes it unnecessary to prematurely discard the entire target backing, it has been found to be desirable to try to increase the useful life of the central bullseye plug itself so that it need not be replaced as frequently as might otherwise be required. Even though the bullseye plug may have accepted plural strikes to the point that the foam material from which it is made has been broken out to form a void, it is a requirement that an arrow not pass through the bullseye plug completely. Pass-throughs, of course, result in damage to the arrow and possibly loss of the arrow or injury to bystanders who may be in the path.

OBJECTS

It is accordingly a principal object of the present invention to provide a target life extender device which cooperates with the replaceable bullseye to prevent arrows from passing through the bullseye zone even after many, many strikes in that zone.

Another and related object is to provide a target life extender which may be used to obviate the need for premature discarding of an archery target.

Still another object of the invention is to provide a target life extender which is inexpensive to manufacture yet extremely effective in its function as far as preventing pass-through of arrows striking the bullseye zone of an archery target.

SUMMARY OF THE INVENTION

The above features, objects and advantages of the invention are attained by providing a resilient pad having a periphery substantially the same size as the diameter of the replaceable bullseye plug, which pad is loosely coupled to the bullseye plug itself through the use of a fabric sleeve in which the pad is contained. The sleeve is fitted over the bullseye plug prior to the insertion of the plug in the surrounding target backing material and, accordingly, the pad is held in place but may yield to the force of an arrow which may penetrate the bullseye plug, thus arresting the momentum of the arrow and preventing a pass-through condition.

Further details as to the construction and mode of operation of the invention can be obtained from a reading of the following Detailed Description of the Preferred Embodiment, especially when considered in conjunction with the accompanying drawings.

DETAILED DESCRIPTION OF THE PREFERRED EMBODIMENT

Figure 1:
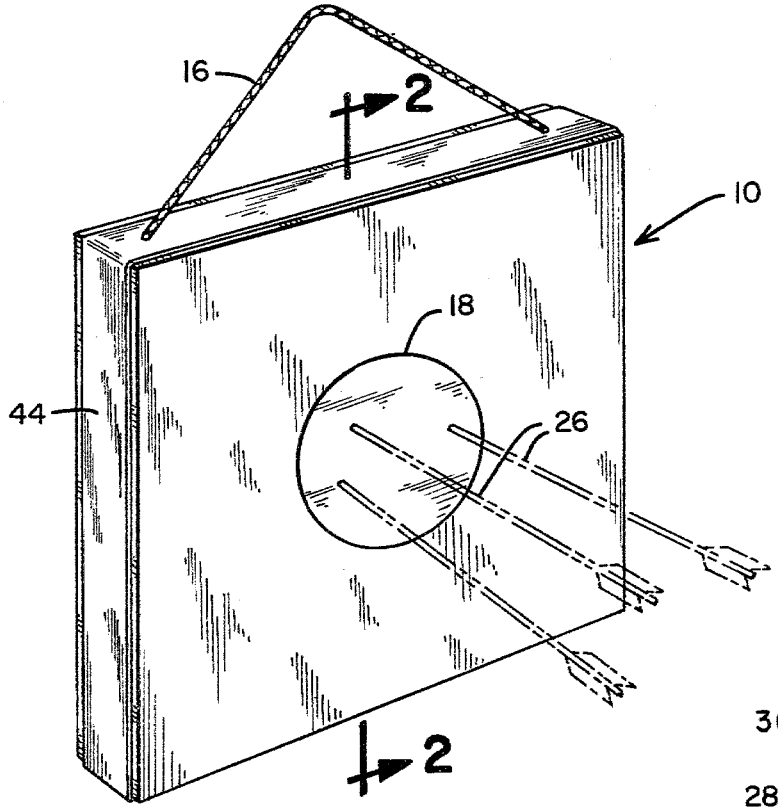
FIG. 1 is a front view of a target on which the present invention finds application.
Figure 2:
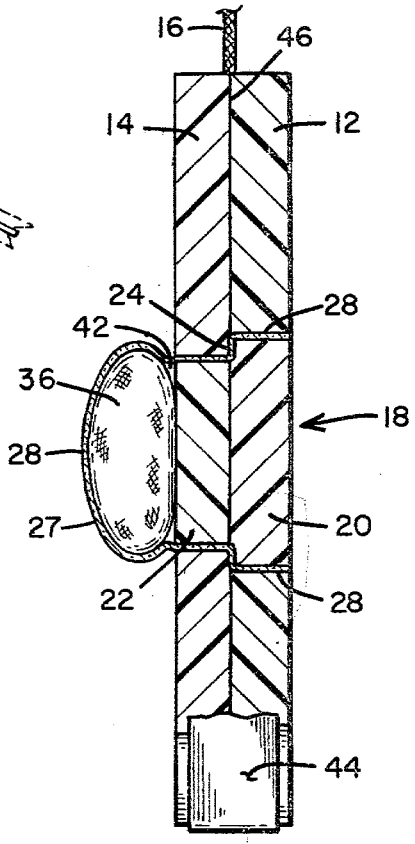
FIG. 2 is a cross-sectional view taken along the lines 2—2 in FIG. 1 showing the target life extender in place.

In accordance with the preferred embodiment of the present invention, and with attention being directed to FIGS. 1 and 2 of the drawing, the archery target backing means generally designated 10 may include first and second sheets 12 and 14 prepared from polyolefin foam. Specifically, polyethylene foam having a density of between about $1\frac{1}{2}$ and 3 pounds per cubic foot has been found to be desirable. The arrangement is provided with a hanging rope as at 16, which may be secured to the laminated sheets by any of a variety of techniques such as adhesive bonding, fusion bonding, or the like.

The center of the target is illustrated as at 18 in the form of a replaceable bullseye arrangement, the bullseye structure being in the form of a removable plug which frictionally fits within circular cutouts provided in the laminated sheets 12 and 14. With reference to FIG. 2, it can be seen that the diameter of the bullseye portion 20 fitting within the sheet 12 is greater than the diameter of the bullseye portion 22 which resides within the aperture formed in the sheet 14. As such, a shoulder 24 is formed which resists the rearward displacement of the bullseye 18. The disks 20 and 22 forming the bullseye zone are preferably made from the same material as the sheets 12 and 14, e.g., a polyethylene foam having a density in the range of from about 1½ to 3 pounds per cubic foot. These disks 20 and 22 would also be bonded together with a suitable adhesive so as to form a generally integral unit.

In FIG. 1, there is shown by means of a phantom line presentation a group of arrows 26-26. In the normal use of the archery target backing means 10 of FIG. 1, the arrows impacting the device after being propelled from the bow will enter the target as illustrated, and depending upon the skill of the archer, will be generally closer or more remote from the center of the bullseye as at 18.

It is, of course, readily apparent that by providing a replaceable bullseye zone as at 18 the lifetime of the overall archery target backing structure 10 may be increased. That is to say, the zone 18 is generally the first to deteriorate through repeated arrow strikes and by making this zone a replaceable plug, when the zone becomes so perforated that the arrow stopping capabilities of the material can no longer be counted upon, the remaining portion of the target may still be sufficiently sound. Hence, by replacing the bullseye, the overall life of the unit is extended.

Even though it is less costly to replace only the bullseye zone 18 as compared to discarding the entire target assembly, it becomes desirable to even extend the life of the bullseye zone 18 itself. By reducing the frequency with which the bullseye zone plug 18 need be replaced, the consumer will naturally benefit from the attendant cost saving.

Figure 3:
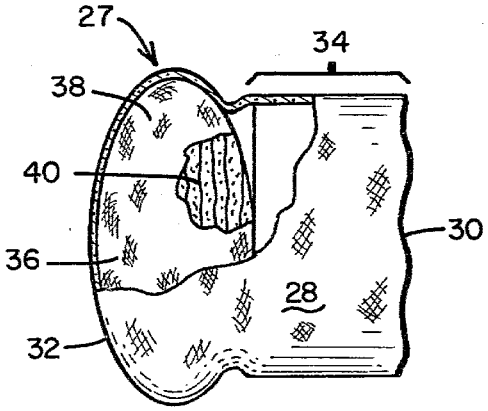
FIG. 3 is a view showing the construction of the target life extender itself.

With reference to FIGS. 2 and 3, the attachment for increasing the useful life of a replaceable plug will now be described. In its simplest form the extender device indicated generally by numeral 27 comprises a cloth or fabric sleeve 28 which is opened at a first end 30 and closed at its opposite end 32 and, in this regard, somewhat resembles a cloth sack having a neck portion 34 of a predetermined length. Disposed in the sleeve or sack is a pad 36 which itself comprises a fabric or cloth covering 38 enclosing resilient batting material 40. The batting material 40 is preferably a loosely woven mass of polyester fibers, but other materials of similar physical characteristics may prove equally suitable. Thus, the pad 36 may resemble a small pillow having a casing 38 and a stuffing 40. The sleeve 28 preferably comprises a knitted nylon fabric which can be made to stretch in the radial direction thereof. Similarly, the casing 38 may be made of the same material.

With reference now again to FIG. 2, it can be seen that the extender device 27 is affixed to the target by first inserting the replaceable bullseye plug 18 into the open end 30 of the sleeve 28 and because of the nature of the material employed, the sleeve will conform to the outside dimension of the bullseye plug 18, both over its larger diameter disk 20 and the smaller diameter disk 22. Next, the closed end 32 of the device 27 is fed through the apertures formed in the mats 12 and 14 as the plug 18 is inserted into the central openings formed in these laminated mats. Hence, the neck portion 34 of the sleeve 28 will be firmly wedged between the periphery of the disks 20 and 22 and the corresponding side walls of the apertures formed in the mats 12 and 14. While not absolutely necessary, it may be found expedient at times to wrap one or more turns of string about the neck portion 34 after the replaceable bullseye plug 18 is inserted therein to insure that the extender device 27 will not become separated from the target assembly during use.

It should also be noted in FIG. 2 that the resilient pad or pillow member 38 contained within the sleeve 28 does not directly abut the backside of the target, but instead a predetermined length of the sleeve 28 is present therebetween and is indicated by numeral 42.

If desired for decorative purposes, an attractive adhesive tape 44 may be utilized to cover the bond line 46 between the mats 12 and 14.

As has been indicated heretofore, the laminate mats 12 and 14 as well as the disks 20 and 22 are preferably fabricated from polyethylene foam, although polypropylene foam may be used with substantially similar results. In the manufacture of polyethylene foam structures, the surface of the foam structure becomes dense where contact is made with a mold surface. Such foam products are, of course, commercially available, with one such foam being available from Etha Corporation under the code designation "Ethafoam".

Preferably, the individual laminate members are secured together at their major faces by utilization of adhesive or the like. In certain instances, fusion bonding may be utilized if desired, although adhesive bonding is preferred for ease and simplicity.

By using the above-indicated materials, the structure tends to be somewhat self-healing in that when an arrow is removed from the target, the material tends to expand and fill the hole created by the entry of the arrow. The indicated materials also exhibit desirable arrow-stopping qualities without causing damage to the tips, shafts or feathers of the arrows. However, after prolonged use, the bullseye zone may be penetrated so frequently with arrows that the foam material actually is chipped away leaving a void. In fact, it is possible that the voids created may reduce the arrow-stopping properties of the foamed plastic material comprising the disks 20 and 22 to the extent that arrows may pass completely through the target were it not for the presence of the extender attachment 27. When the extender is in place as indicated in FIG. 2 and an arrow penetrates through the bullseye zone, the tip of the arrow will strike the pillow member 36, moving it outwardly and stretching the portion 42 of the sleeve 28 between the rear face of the target 10 and the pad 36. It has been found that the mass of the flexible, compressible pad 36 retards the progress of the arrow and prohibits passthrough. It has further been found that the tip of the arrow will not penetrate the covering 38 of the pad 36 even after many hours of continued use.

In practice, it has been found that by utilizing the target extender device 27 in combination with the target 10 and its replaceable bullseye plug 18 that the plug 18 remains serviceable three to five times as long as otherwise if the device 27 is not employed in combination with the target assembly.

While the preferred embodiment of the invention has been described in detail, it is apparent that various changes and modifications may be made to the overall arrangement without departing from the spirit and scope of the invention. Accordingly, the true scope of the invention is to be determined from the accompanying claims.

What is claimed is:

1. An archery target comprising:

(a) at least one sheet of foamed plastic material of predetermined size and thickness dimensions, said sheet having a central opening of a predetermined diameter;

(b) a replaceable bullseye member comprising first and second circular disks of foamed plastic material bonded together along abutting major surfaces thereof, said first disk of a diameter corresponding to said predetermined diameter of said opening in said one sheet and said second disk of a greater diameter;

(c) a flexible tubular sleeve member having one closed end and one open end; and (d) a resilient pad member contained within said flexible sleeve member and abutting said closed end of said sleeve member, said open end of said sleeve member surrounding the side surfaces of one of said first or second disks when said replaceable bullseye member is inserted in said central opening or openings.

2. An archery target comprising:

(a) first and second rectangular sheets of foamed plastic material of predetermined length, width and thickness dimension, said sheets being bonded together along abutting major surfaces thereof, said first sheet having a central opening of a predetermined diameter and said second sheet having a central opening concentric with but of greater diameter than said opening in said first sheet;

(b) a replaceable bullseye member comprising first and second circular disks of foamed plastic material bonded together along abutting major surfaces thereof, said first disk of a diameter corresponding to said predetermined diameter of said opening in said first sheet and said second disk of a diameter corresponding to said central opening in said second sheet;

(c) a flexible tubular sleeve member having one closed end and one open end; and (d) a resilient pad member contained within said sleeve member and abutting said closed end of said sleeve member, said open end of said sleeve member surrounding the side surfaces of one of said first or second disks when said replaceable bullseye member is inserted in said central opening or openings.

3. Apparatus as in claim 1 or 2 wherein said resilient pad member comprises a cloth enclosure containing a mass of fiberous material having an outer perimeter at least as large as the circumference of said second disk.

4. Apparatus as in claim 1 wherein said fiberous material comprises a plurality of layers of polyester fiber batting.

5. Apparatus as in claim 1 or 2 wherein said flexible sleeve is formed from woven nylon threads.

* * * * *